US005956871A

United States Patent [19]

Korsen

[11] Patent Number: 5,956,871

[45] Date of Patent: Sep. 28, 1999

[54] SHOE SPIKE APPARATUS

[76] Inventor: David L. Korsen, P.O. Box 1806, Twin Falls, Id. 83303-1806

[21] Appl. No.: 08/877,297

[22] Filed: Jun. 17, 1997

Related U.S. Application Data

[63] Continuation-in-part of application No. 08/548,610, Oct. 26, 1995, Pat. No. 5,638,615, which is a continuation-in-part of application No. 08/249,270, May 25, 1994, Pat. No. 5,475,937.

[51] Int. Cl.[6] ..... A43C 15/02

[52] U.S. Cl. ..... 36/134; 36/67 D

[58] Field of Search ..... 36/134, 67 D, 36/36 B, 36 C, 59 A, 36 R, 42, 15

[56] References Cited

U.S. PATENT DOCUMENTS

| | | | |
|---|---|---|---|
| 1,278,320 | 9/1918 | Ellithorpe | 36/59 A |
| 1,344,972 | 6/1920 | Armour | 36/59 A |
| 1,366,518 | 1/1921 | Buchman . | |
| 1,601,700 | 9/1926 | Morrison | 36/59 A |
| 1,797,668 | 3/1931 | Morisse | 36/134 X |
| 2,288,168 | 6/1942 | Leu | 36/36 R |
| 2,478,810 | 8/1949 | Deschenes et al. | 36/36 B |
| 2,607,134 | 8/1952 | Langer | 36/59 |
| 2,608,007 | 8/1952 | Shapiro | 36/2.5 |
| 2,734,288 | 2/1956 | Phillips et al. | 36/36 B |
| 2,745,197 | 5/1956 | Holt | 36/134 X |
| 3,351,967 | 11/1967 | Dardig | 12/147 |
| 3,403,461 | 10/1968 | McCarney | 36/67 |
| 3,413,737 | 12/1968 | Kneebusch . | |
| 3,559,308 | 2/1971 | Bernier et al. | 36/134 |
| 3,566,489 | 3/1971 | Morley | 36/67 |
| 4,035,934 | 7/1977 | Hrivnak | 36/67 D |
| 4,240,215 | 12/1980 | Broussard | 36/67 D |
| 4,262,434 | 4/1981 | Michelotti | 36/67 D |
| 4,318,232 | 3/1982 | Ching | 36/73 |
| 4,380,878 | 4/1983 | Skaja | 36/67 D |
| 4,414,763 | 11/1983 | Bente | 36/134 |
| 4,445,288 | 5/1984 | Frör | 36/134 |
| 4,492,047 | 1/1985 | Arff | 36/134 |
| 4,633,600 | 1/1987 | Dassler et al. | 36/134 |
| 4,644,672 | 2/1987 | Dassler et al. | 36/134 |
| 4,648,187 | 3/1987 | Dassler et al. | 36/134 |
| 4,698,923 | 10/1987 | Arff | 36/128 |
| 4,706,394 | 11/1987 | Regula | 36/67 D |
| 4,875,300 | 10/1989 | Kazz | 36/134 |
| 5,027,532 | 7/1991 | MacNeill et al. | 36/134 |
| 5,123,184 | 6/1992 | Ferreira | 36/134 |
| 5,259,129 | 11/1993 | Deacon et al. | 36/127 |
| 5,475,937 | 12/1995 | Korsen | 36/67 D X |
| 5,638,615 | 6/1997 | Korsen . | |

FOREIGN PATENT DOCUMENTS

| | | |
|---|---|---|
| 10591 | 3/1934 | Australia . |
| 61715 | 10/1982 | European Pat. Off. . |
| 320029 | 10/1929 | France . |
| 2260084 | 12/1972 | Germany . |
| 216399 | 8/1941 | Sweden . |
| 209315 | 1/1924 | United Kingdom . |
| 401847 | 11/1933 | United Kingdom . |

*Primary Examiner*—Ted Kavanaugh
*Attorney, Agent, or Firm*—Craig M. Korfanta

[57] ABSTRACT

A shoe spike apparatus permitting quick interchange or replacement of gripping elements, which includes a shoe sole attachment plate with a downwardly depending stabilizer shaft, a plurality of spring fingers affixed to the plate, and a spike member having a base provided with a recess for receiving the stabilizer shaft and an exterior geometric configuration on the base which mates with the spring fingers so as to retain the spike member firmly and without lateral movement to the attachment plate and shaft. In one embodiment a circular construction of engaging surfaces of the spike member and the socket and spring fingers allows rotational movement of the spike member relative to the socket to prevent rotational stress which might otherwise tear the sole attachment plate from the sole in which it is embedded. Rigid contact surfaces permit only unidirectional removal of the spike member from the socket for ensuring the integrity of the snap lock mechanism.

10 Claims, 15 Drawing Sheets

SHOE SPIKE APPARATUS

This is a continuation-in-part of U.S. application Ser. No. 08/548,610 filed Oct. 26, 1995 now U.S. Pat. No. 5,638,615, entitled SHOE SPIKE APPARATUS which is a C.I.P. of Ser. No. 08/289,270, filed May 25, 1994, U.S. Pat. No. 5,474,937.

FIELD OF THE INVENTION

This invention relates to spike apparatus for shoes and, more particularly, to interchangeable and readily removable and replaceable spikes/cleats for athletic shoes.

DESCRIPTION OF THE PRIOR ART

It is to be understood that use of the term "spikes" in the following description includes all types of gripping elements which may be used on shoes.

The desirability of cleats and spikes on shoes for superior traction has long been recognized, particularly in the athletic endeavors of runners, golfers, football players, soccer players, and the like. It is also highly desirable that individual spikes be readily removable and replaceable where the spike has become broken, deformed, or otherwise impaired and where other gripping elements are desired.

Typifying the present art in an attempt to provide such spikes or cleats are the two patents of Dassler et al, U.S. Pat. Nos. 4,633,600 and 4,644,672, as well as the patent of A. Hrivnak, U.S. Pat. No. 4,035,934. Dassler utilizes an elastic annular rib in a snap-lock arrangement and a screw-on type element to hold the gripping members to a shoe stud. The Hrivnak device utilizes a pair of spring members having shoulders which lock into a flange on the spike member to hold the spike in place.

Problems in the prior art include the loss of spikes which are screwed into place or constructed of elastic material; damage to the supporting sole where rotational stress is placed upon a non-rotatable spike; complicated and expensive spike retention members; time required to interchange spikes; and lateral movement of the spike members within sockets of studs, also causing loss or damage.

SUMMARY OF THE INVENTION

The shoe spike apparatus of the present invention overcomes the problems of the prior art in providing shoe attachment means provided with a spring retainer and a stabilizer shaft perpendicularly depending from the attachment means and a spike member having a section for mating with the spring retainer for locking the spike member to the socket. The circular rigid shaft is received within a mating opening in the spike member to prevent any lateral movement between the spike member and the socket and yet permit rotational movement of the spike member within the socket to eliminate rotational stress on the attachment means engagement with the sole of the shoe. Such construction allows removal of the spike member from the socket only in a unidirectional manner to ensure the locking integrity of the snap ring. All engagement members, other than the spring retainer, are inflexible for precision fit.

An additional embodiment of the invention has a non-rotatable spike member and cooperating socket assembly which locks the spike member and prevents both lateral movement as well as rotational movement of the spike member with respect to the shoe sole. This construction also allows removal of the spike member from the socket only in a unidirectional manner.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
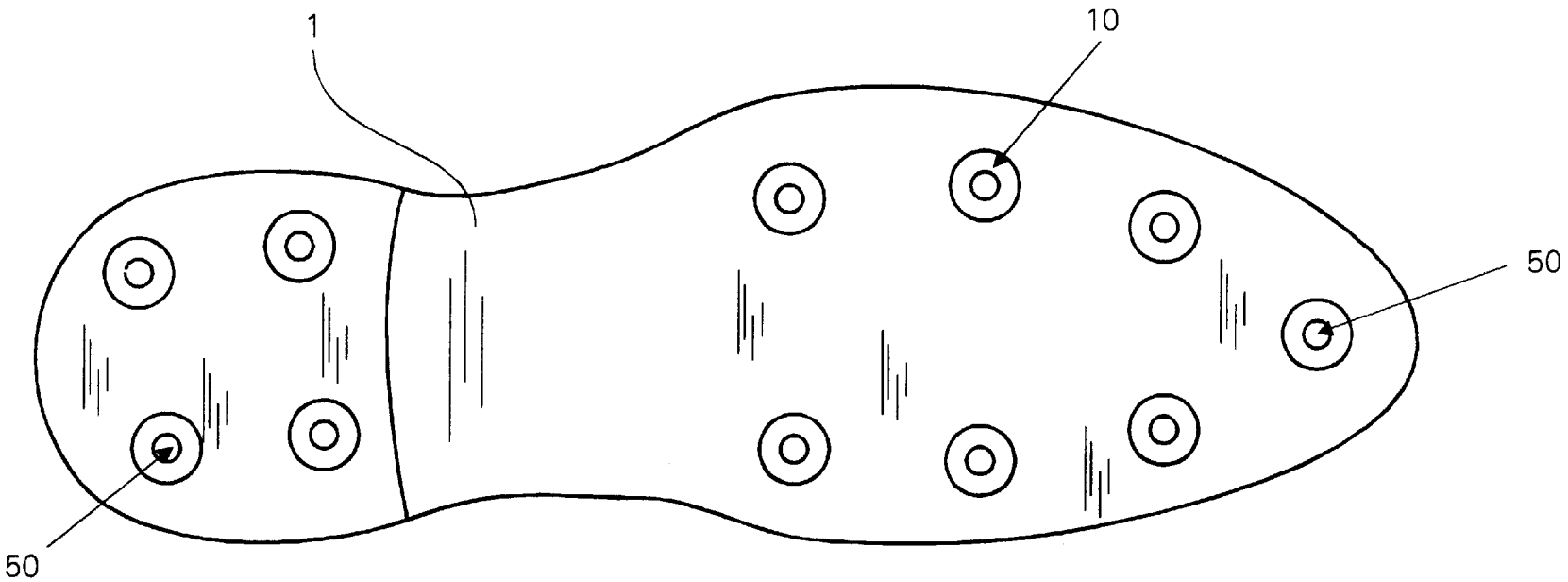
FIG. 1 is a plan view of a shoe sole showing the shoe spike members of the present invention installed.
Figure 2:
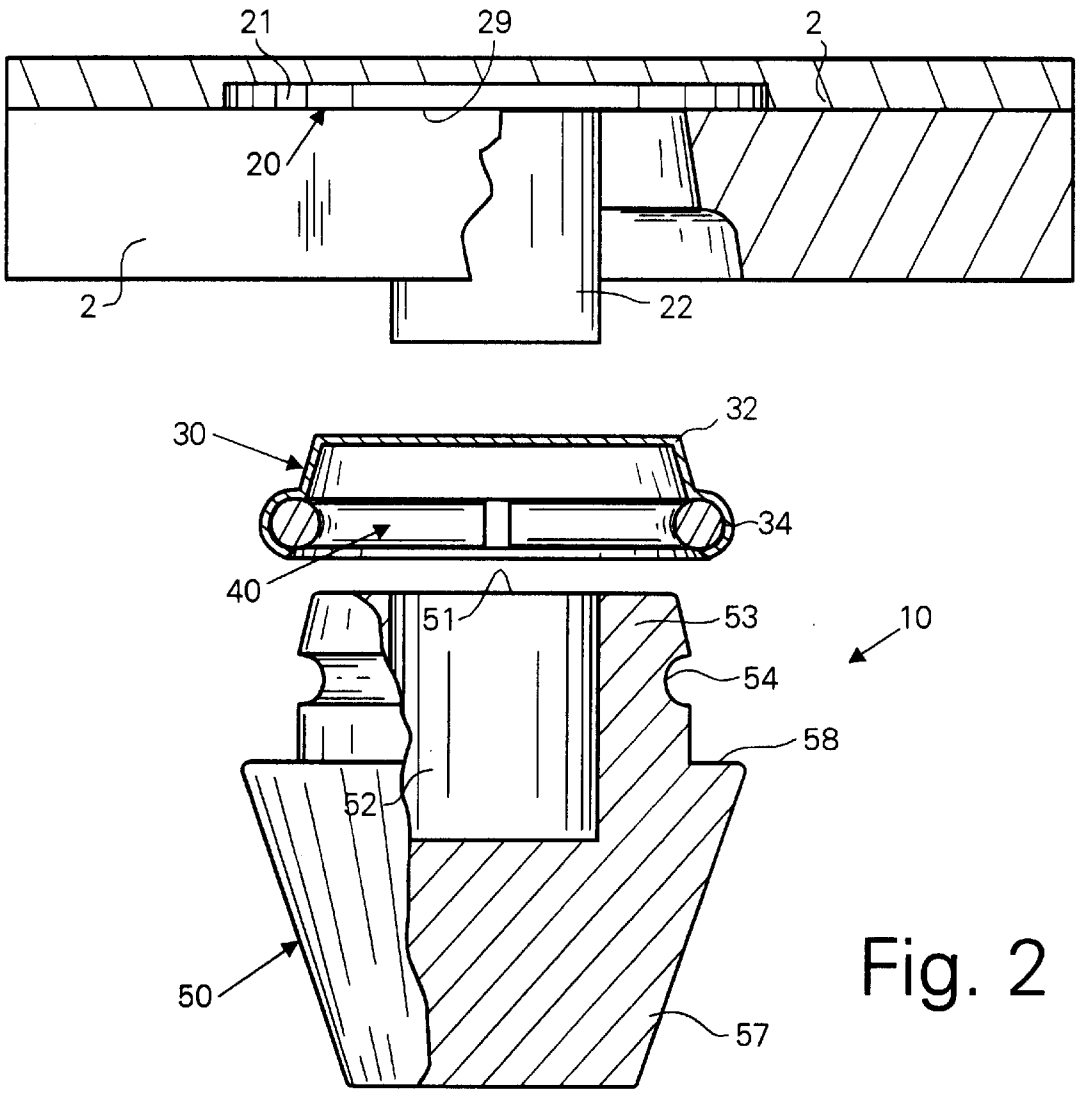
FIG. 2 is an exploded side view, in partial section, of the present invention as attachable to a shoe sole.

Referring now to the drawings, FIGS. 1–4, a first embodiment to be preferred of shoe spike apparatus 10, made according to the present invention, is disclosed. Shoe spike apparatus 10 includes, generally, shoe attachment means 20, snap ring socket 30, snap ring 40, and spike member 50.

Figure 3:
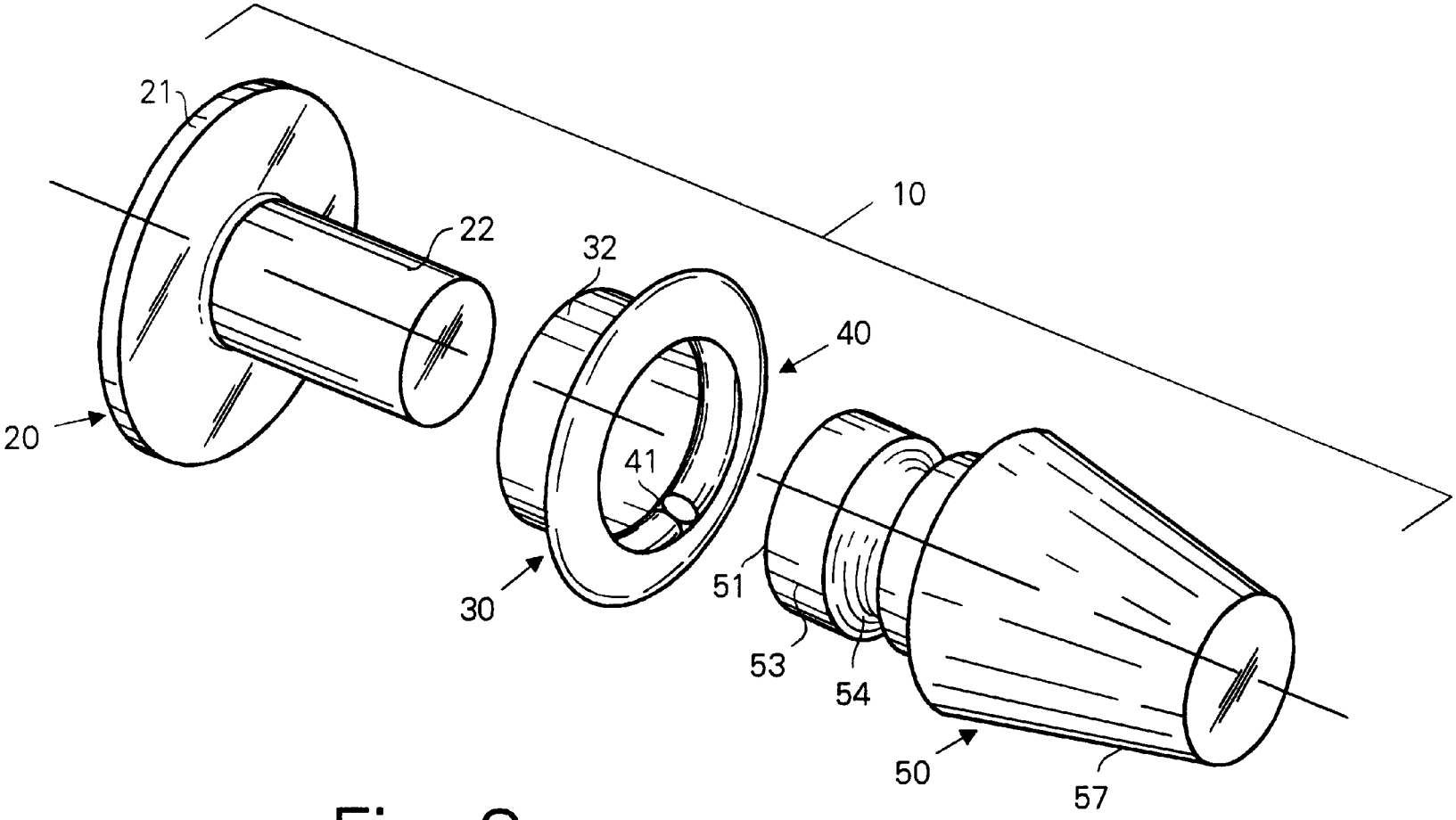
FIG. 3 is a perspective exploded view of the device of the present invention.
Figure 4:
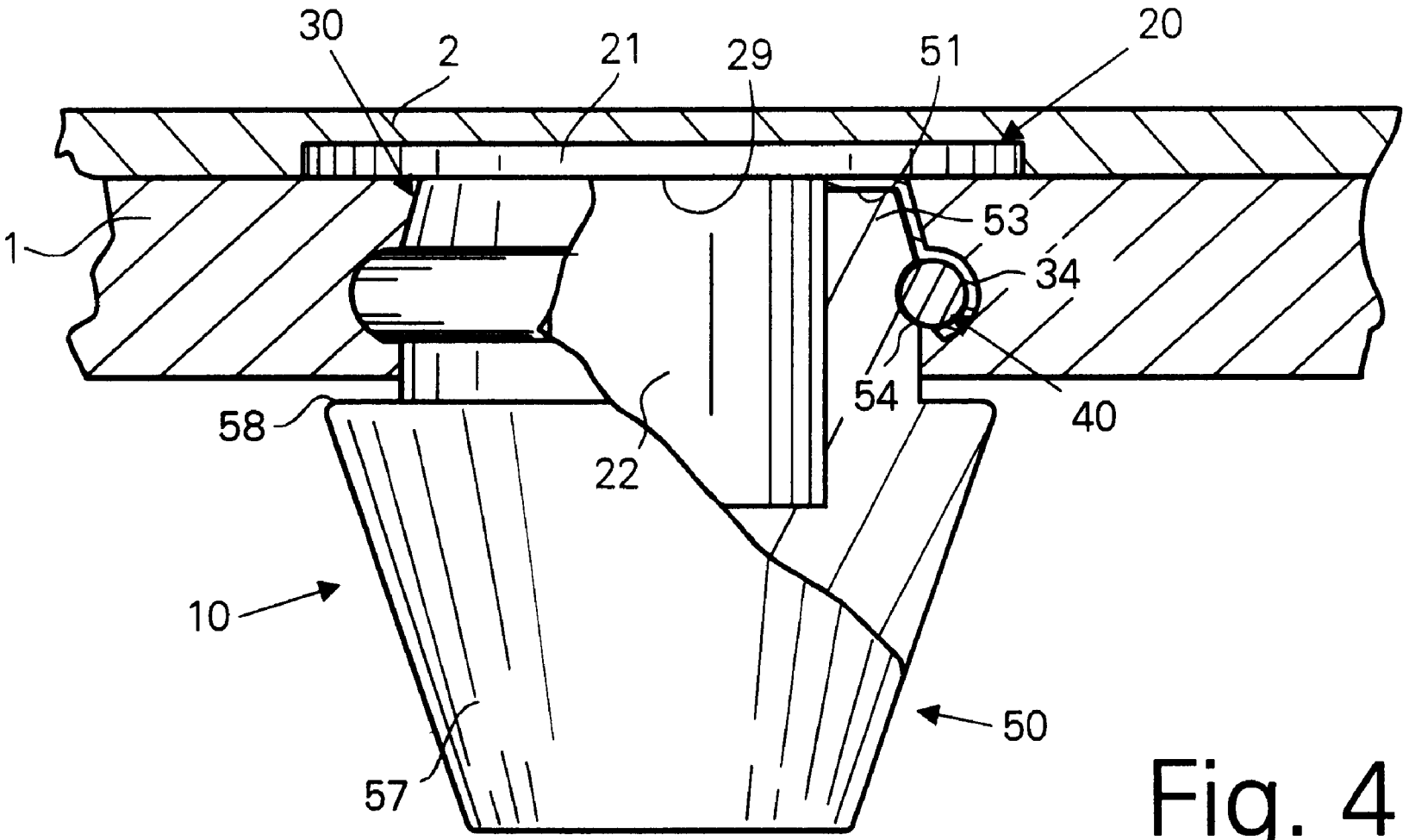
FIG. 4 is a side view with all structural elements in place for use, in partial section.

Shoe attachment means 20 includes anchor plate 21 made of rigid material, preferably of metal such as stainless steel. The anchor plate includes planar opposing surfaces and may be circular in form, as shown in FIG. 3. The anchor plate is embedded in outer sole 1 of the shoe or between the outer sole and shoe base 2. Plate 21 is provided with a downwardly depending stabilizer shaft 22, also constructed of rigid material such as stainless steel. Shaft 22 is perpendicularly affixed to plate 21 by means such as welding, screws, or by other conventional fasteners, or may be integral with the plate. The shaft may be either hollow or solid, solid being preferred, and is circular in cross section for reasons hereinafter stated.

Also affixed to the anchor plate by means such as welding or otherwise is rigid snap ring socket 30, also constructed of metal. Socket 30 is tubular in shape, having a cylindrical wall 32 which is coaxially spaced relative to stabilizer shaft 22. Wall 32 defines on its inner surface an annular groove 34 for receiving ring 40. Snap ring 40 is constructed of flexible steel, circular in cross section, and defines an expansion-contraction gap 41, as is conventional with snap rings.

Spike member 50 is provided with base portion 53 and gripping portion 57. The base portion may be integral with the gripping portion or the gripping portion may be constructed of a different material than the base portion, depending upon the gripping characteristics required. Where construction is of a material differing in composition from the base portion, the gripping portion may be affixed to the base portion by any suitable means. It is essential to the invention that the base portion be constructed of a rigid material, stainless steel being preferred, because of its engagement with both snap ring 40 and stabilizer shaft 22.

Base portion 53 is circular in cross section and contains on its exterior surface annular groove 54 for receiving snap ring 40 contained within groove 34 of socket 30 to snap-lock spike member 50 to the socket and, hence, shoe attachment means 20. The base portion also defines a recess or opening 52, perpendicular to a planar end surface 51, for snug reception of and engagement with shaft 22 of shoe attachment means 20. It is to be noted and appreciated that this circular construction allows complete and free rotation of spike member 50 within socket 30 to eliminate tearing of the anchor plate from the sole, which often results where rotation of the spike member is not possible. Planar end surface 51 of the spike member presents a surface for flush engagement with surface 29 of plate 21, cooperating in the rotational movement of the spike member.

Gripping portion 57 of spike member 50 may be of any suitable material and of any suitable length and shape, such dimensions being dependent upon designed use. The gripping portion is provided with tool engagement means for removal of spike member 50 from socket 30 and from shaft 22 of shoe attachment means 20. In the embodiment shown, the tool engagement means comprises shoulder 58 extending about the peripheral base of the gripping portion of the spike. Any edged tool of suitable dimensions or a coin may be used to dislocate spike member 50 from the socket and snap ring. It is obvious that other tool engagement means may be provided, such as recesses, clamping areas, etc.

Figure 5:
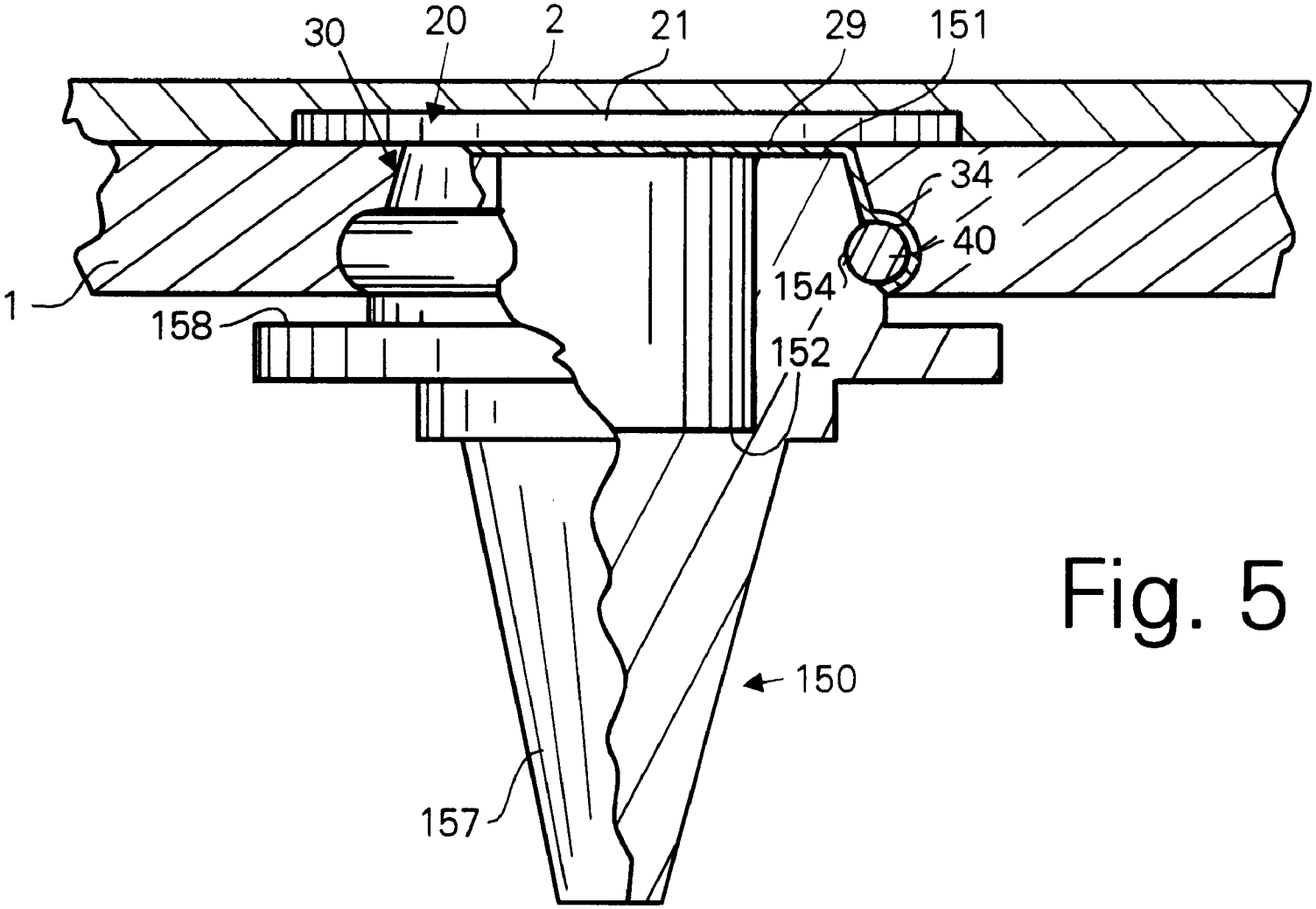
FIG. 5 is a side view of a second embodiment of the present invention, in partial section.

Referring now to FIG. 5, a second embodiment of the present invention may be seen. Like numbers refer to the same structural elements as in the first embodiment. The primary difference in the second embodiment is spike member 150, which is provided with base portion 153 and gripping portion 157. As in the first embodiment, the base portion is provided with an annular groove 154 for receiving snap ring 40 and a recess 152 for receiving shaft 22 of shoe attachment means 20. Unlike the first embodiment, spike member 150 includes an expansive shoulder in the nature of apron 158, serving to cover and act as a shield to protect underlying snap ring socket 30 from entry of soil, grass, or other debris.

Again referring to the first embodiment, for installation of spike member 50 into socket 30, the spike member is simply inserted into socket 30 with opening 52 of the spike member receiving shaft 22 of shoe attachment means 20. A slight pressure on spike gripping portion 57 causes the spike member to move into socket 30, with groove 54 of the spike member snapping into locking engagement with snap ring 40, held in groove 34 of socket 30. It will be noted that lateral movement is precluded between the spike member and the socket and that the only directional forces operable to remove the spike member are in a direction opposite to that of installation, i.e., downward movement, perpendicular to anchor plate 21. It will also be noted, then, that the natural position of the shoe and weight of the user at all times tend to keep the shoe spike in place.

For removal of a spike member from socket 30, a coin, screw driver, or other edged tool is inserted between shoulder 58 of spike member 50 and the bottom surface of socket 30. The spike member is then pried from its engagement with the snap ring and socket.

Figure 6:
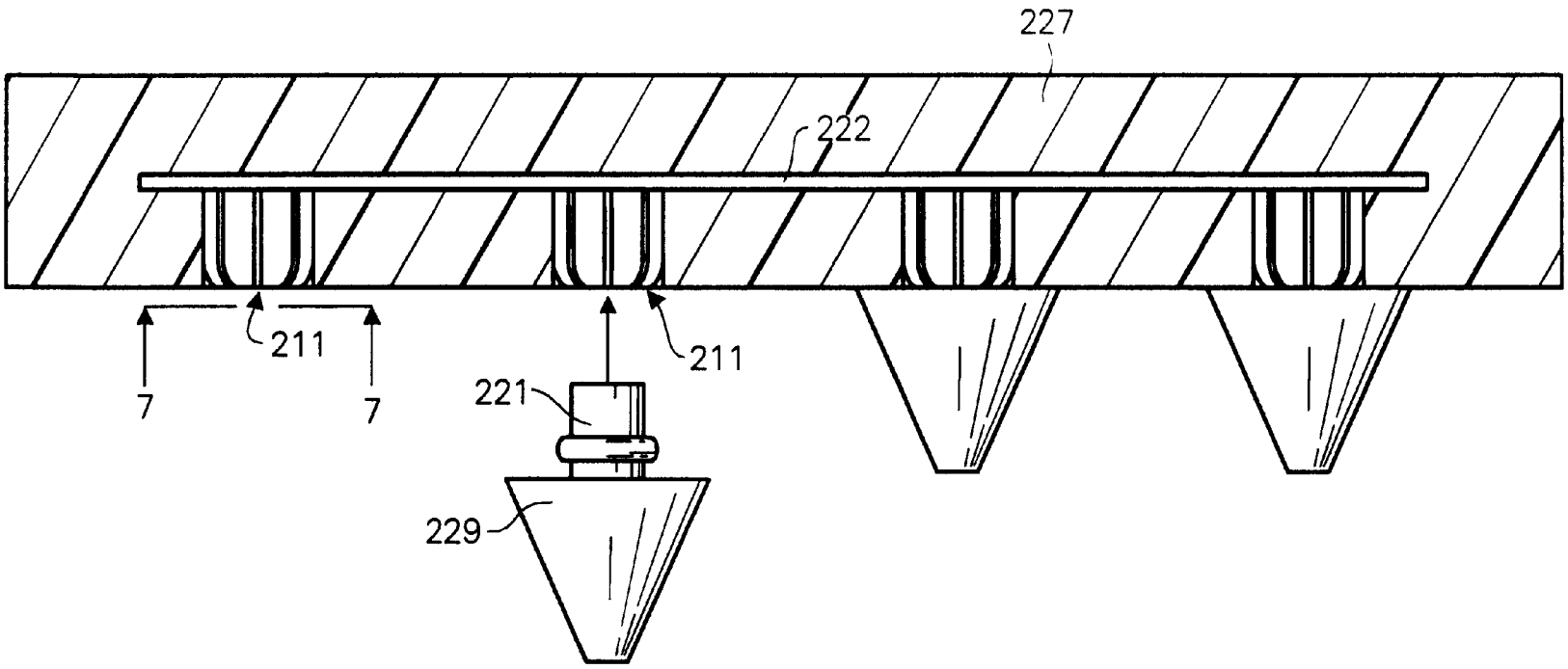
FIG. 6 is a partial cross-sectional view of a plurality of spike members in place in and removed from a shoe sole.
Figure 7:
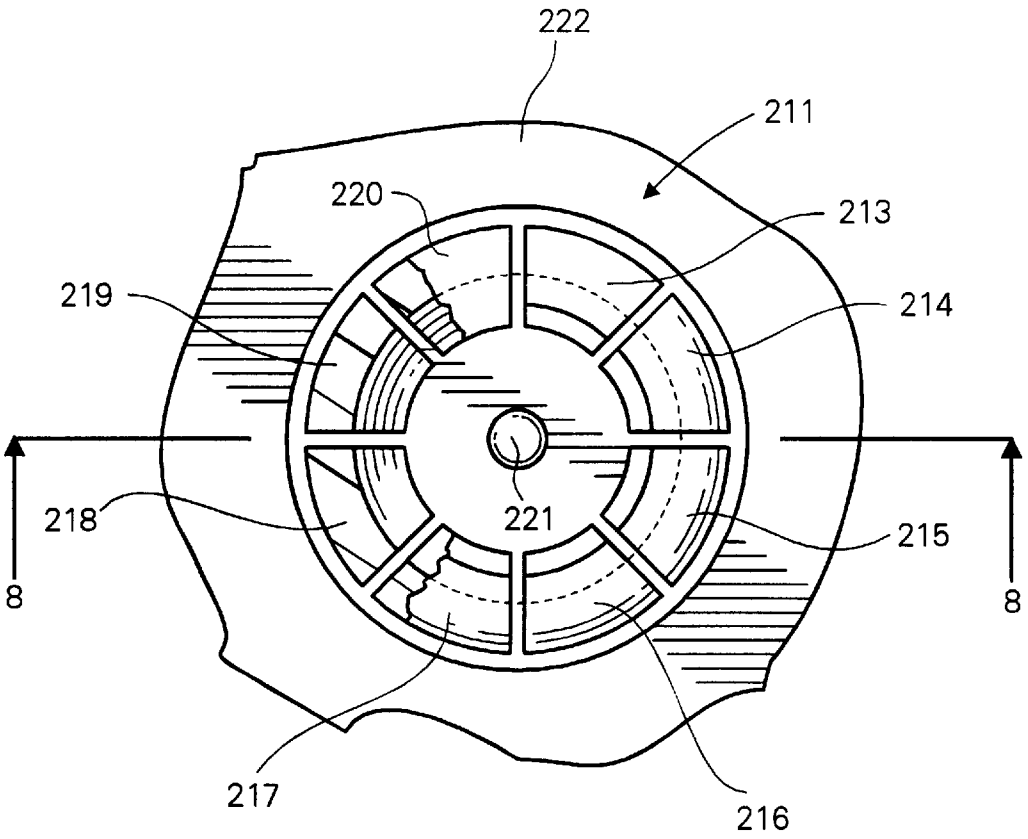
FIG. 7 is a partial top view partly in section taken along the lines 7—7 of FIG. 6.
Figure 8:
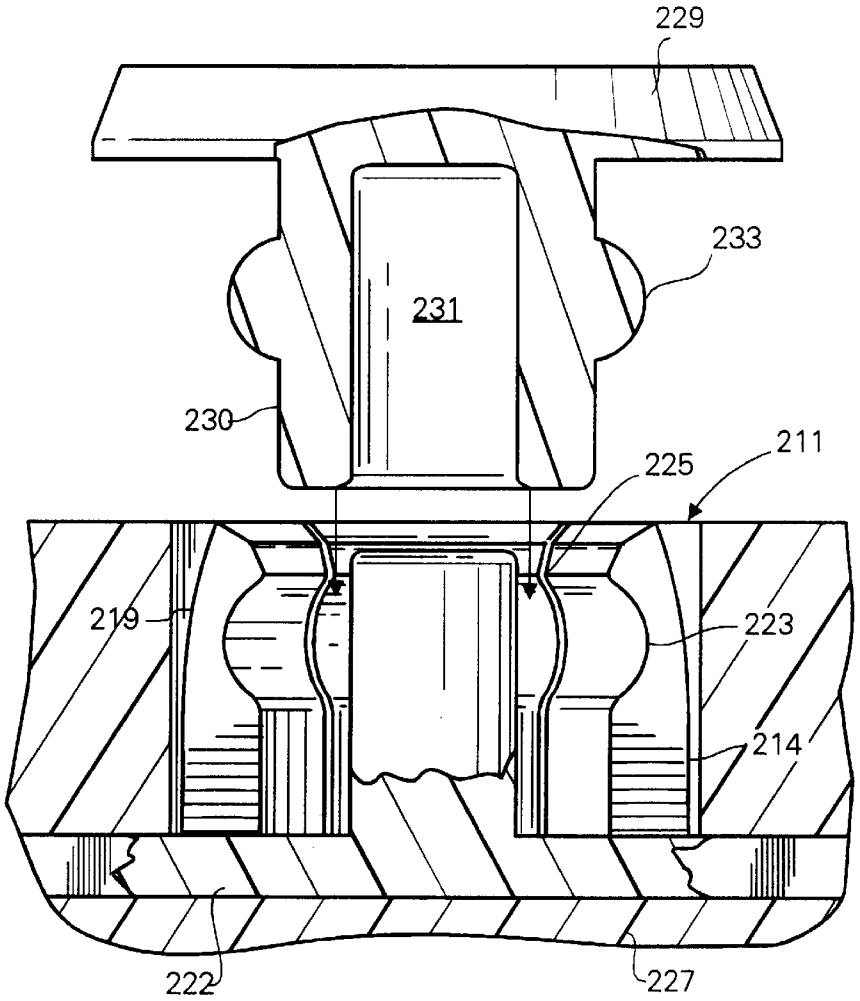
FIG. 8 is an enlarged cross-sectional view taken through lines 8—8 of FIG. 7 and includes an exploded view of the associated spike member.

Turning now to FIGS. 6, 7, and 8, there is shown a further embodiment of the present invention. FIG. 6 shows the sole 227 of a shoe in which anchor plate 222 is embedded. A plurality of sockets 211 are shown which contain the stabilizing shaft and spring retainer. One spike 229 and associated shaft 221 are shown in an exploded view with spike 229 above socket 211 ready for insertion therein.

FIG. 7 is a top view taken through lines 7—7 of FIG. 6 illustrating stabilizer shaft 221 with spring retainer 211 secured about shaft 221. In this embodiment, spring retainer 211 includes spring fingers 213, 214, 215, 216, 217, 218, 219, and 220. While a specific number of spring fingers are shown in this embodiment and in the next embodiment, it is to be understood that the invention is not limited to any particular number of such spring fingers.

The details of the components of FIGS. 6 and 7 are more clearly shown in the cross-sectional view of FIG. 8. The spring fingers, here shown as 214 and 219, extend upwardly from anchor plate 222, as does stabilizer shaft 221. Each of the spring fingers are identical and, accordingly, the detailed description will be limited to one of such spring fingers. Spring finger 214 is shown as including concave section 223 located substantially in the mid-section of the finger. Above concave section 223, spring finger 214 terminates in bevel 225 for purposes which will become apparent from the following description.

In this embodiment, base 230 includes circular borehole 231, which is geometrically configured so as to mate with stabilizer shaft 221 when the two parts are joined. The circumferential convex fingers are integral with stabilizer shaft 221 and extend outwardly therefrom. Convex ring 233 on base 230 is of a geometrical configuration such that it mates with concave section 223 of the spring members when the two parts are mated. In order to assist entry of stabilizer shaft 221 into socket 211, fingers 214 include bevel 225.

As will be evident, this embodiment provides the required stability wherein base 230 can be removed from its position about stabilizer shaft 221 only in a vertical, or 90°, direction. The spring fingers, when mated with circular ring 233, retain the base within the socket so as to prevent removal without an exerted force in a vertical direction. Horizontal movement of base 230 is prevented by stabilizer shaft 221. At the same time, base 230 is rotatable about stabilizer shaft 221 in the same fashion as discussed in the previous embodiments.

While the spring fingers shown in FIGS. 6–8 could be separately secured to an anchor plate, the anchor plate, stabilizer shaft and spring fingers shown in this particular embodiment are a of a single unitary construction and may be molded from suitable plastics such as Delrin®, available from E.I. du Pont de Nemours & Company, or die cast or milled from a suitable metal which has the necessary flex.

Figure 9:
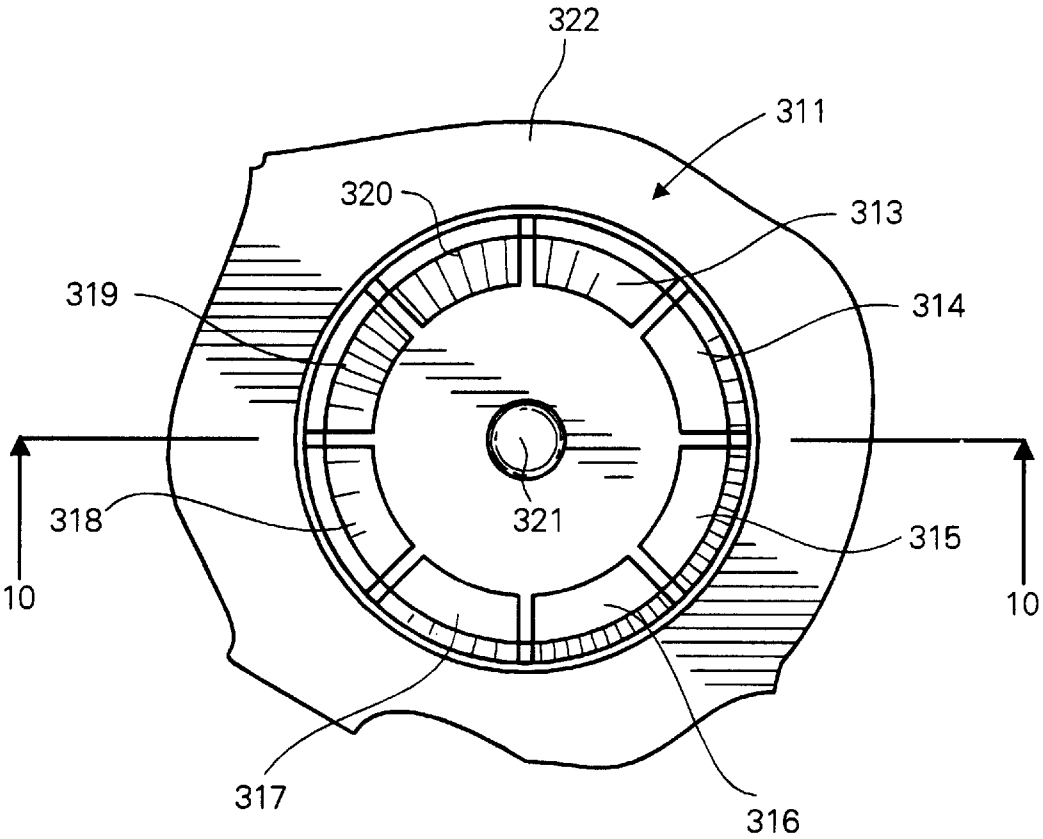
FIG. 9 is a partial top view of a further modification of the spike member retainer of the present invention.
Figure 10:
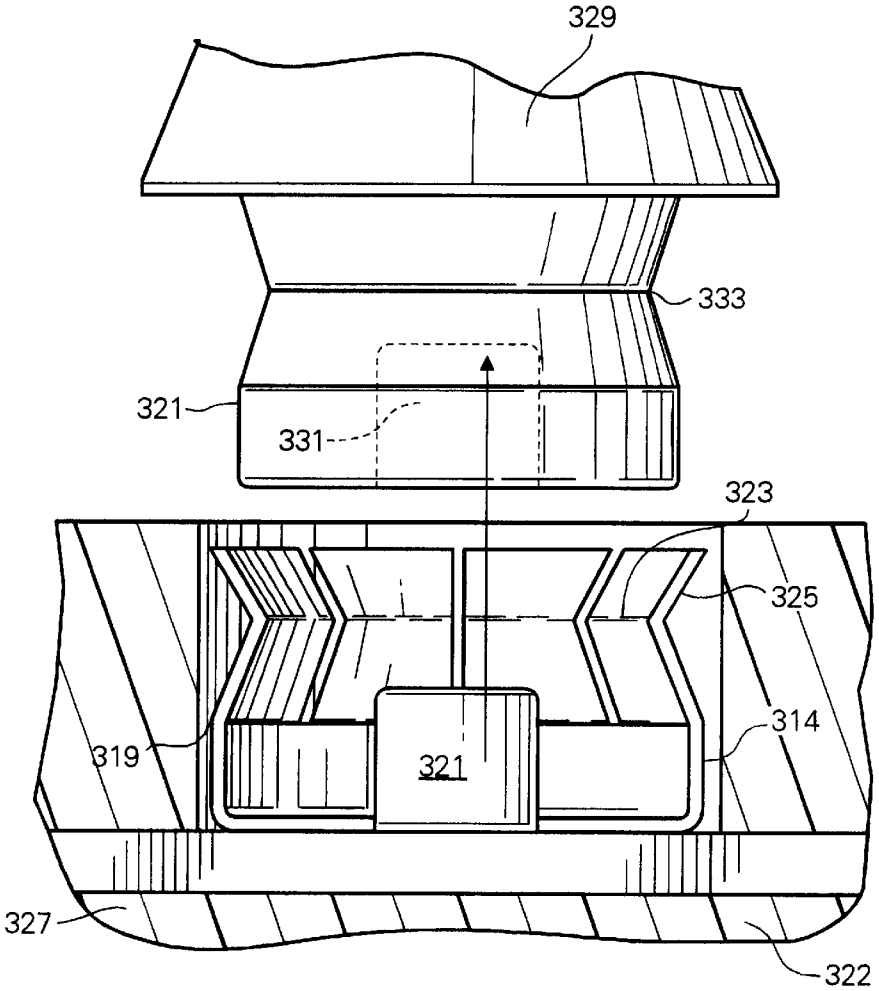
FIG. 10 is an enlarged cross-sectional view taken through lines 10—10 of FIG. 9 and includes an exploded view of the associated spike member.
Figure 11:
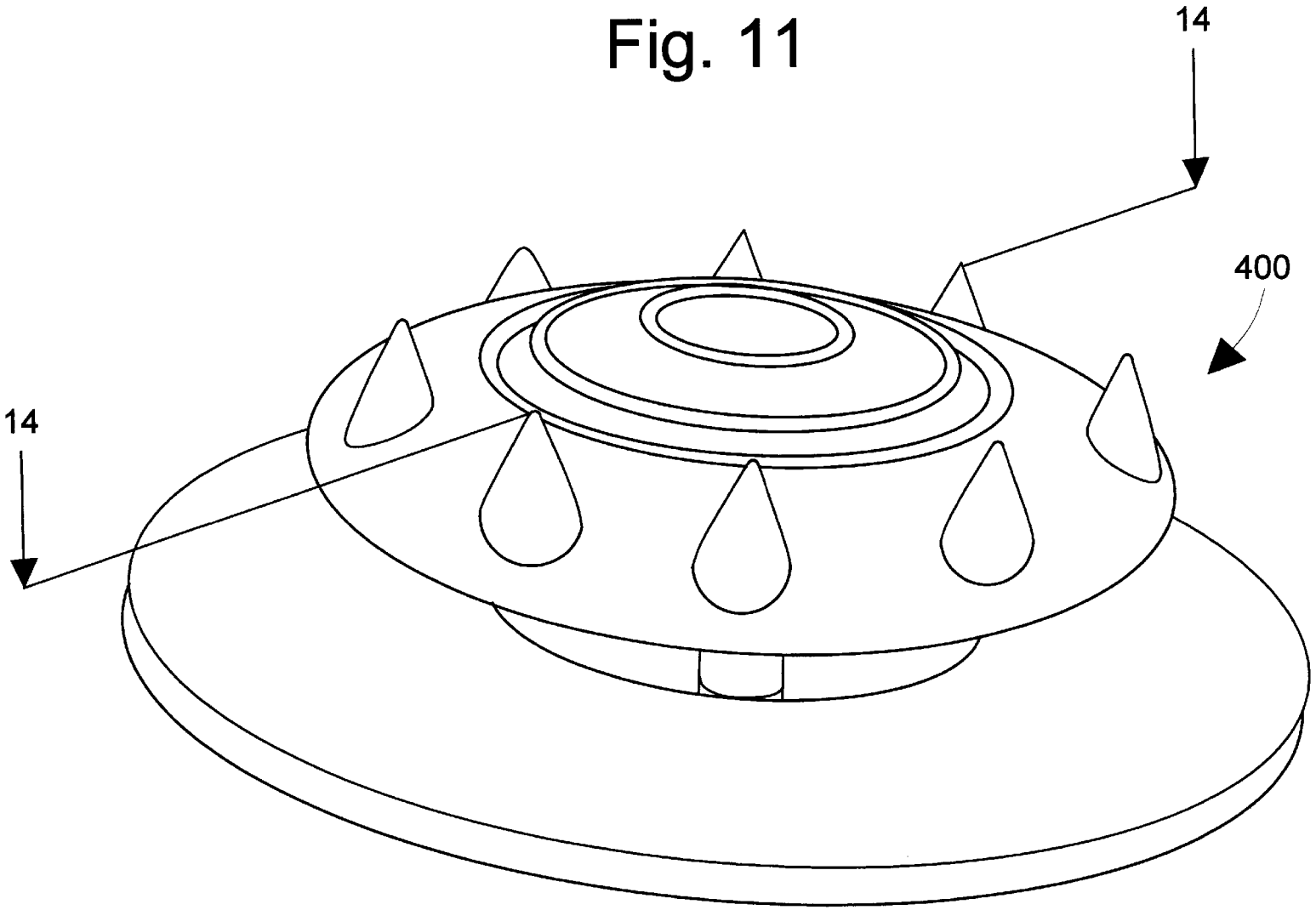
FIG. 11 is a perspective view of yet another embodiment of the device of the present invention.
Figure 12:
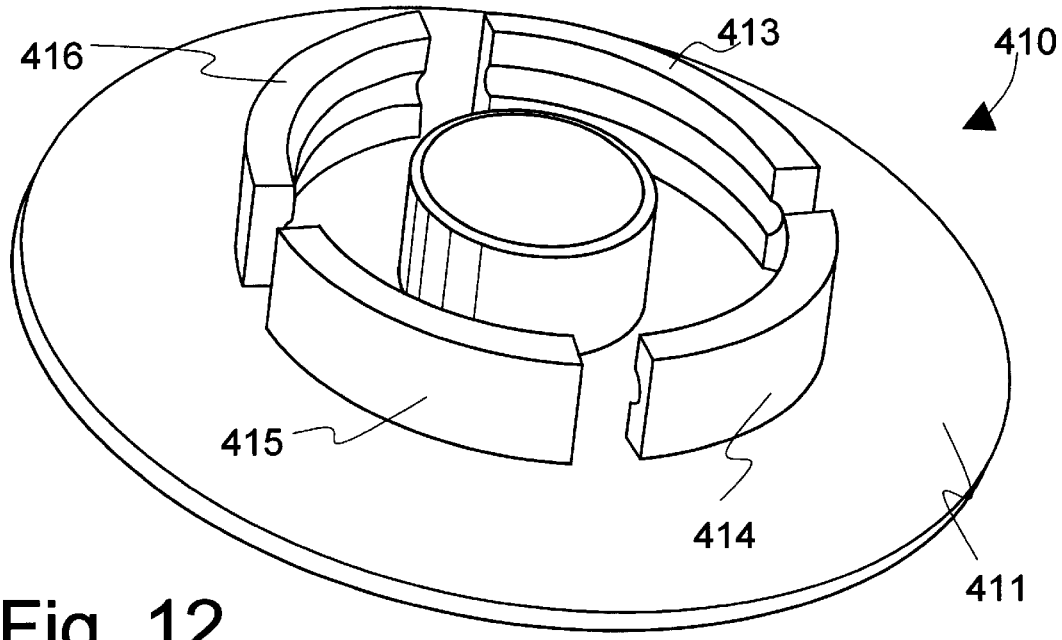
FIG. 12 is a top perspective view showing the receptacle portion to advantage.
Figure 13:
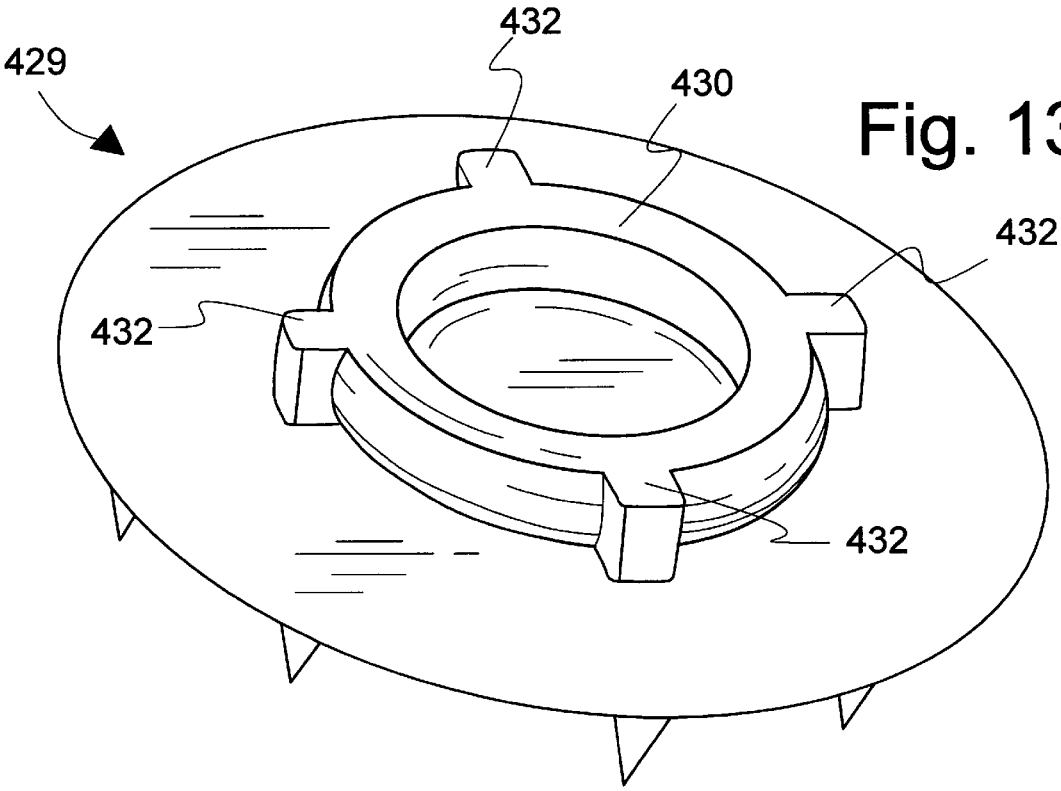
FIG. 13 is a bottom perspective view showing the spike portion to advantage.
Figure 14:
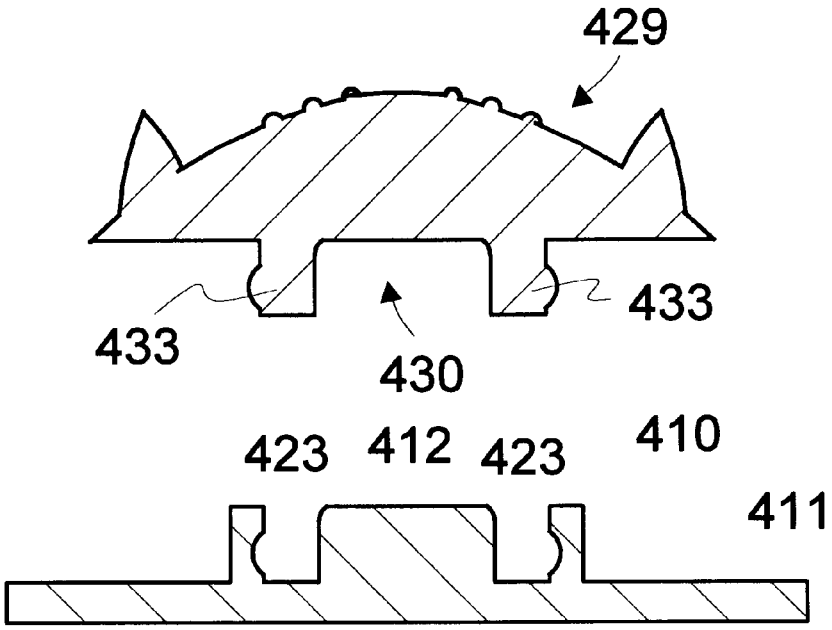
FIG. 14 is an exploded cross-sectional view of the spike and retainer assembly shown in FIGS. 1 1 and 12 and taken along section line 14—14.
Figure 15:
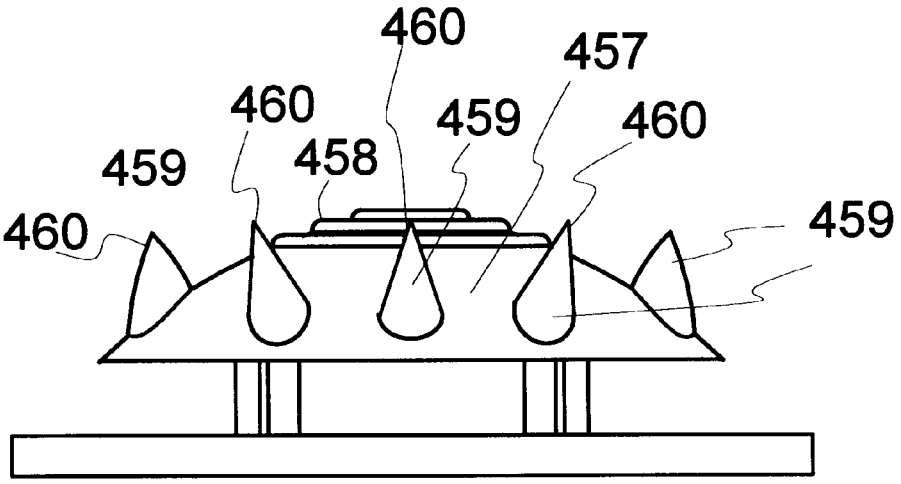
FIG. 15 is a side elevation view of the spike and retainer assembly.

Referring to FIGS. 9 and 10, a still further embodiment of the present invention is disclosed. The basic configuration of this embodiment is similar to that shown in FIGS. 6–8, wherein stabilizer shaft 321 extends upwardly from anchor plate 311 and is surrounded by spring fingers 313, 314, 315, 316, 317, 318, 319, and 320. In this embodiment, the spring fingers are secured to the anchor plate by any known means such as welding, adhesive, etc.

As more clearly shown in FIG. 10, all of the spring fingers extend upwardly and are identical. As shown, spring finger 314 has a reduced circumferential section 323 so as to create a flair at the open end of the spring. Base 321 includes circular borehole 331 and it further includes reduced circumferential section 333 which extends below spike 329. Reduced section 333 is geometrically configured so as to mate with section 323 of the spring fingers. Thus, base 321 is held in place by the springs in the same fashion as discussed above and can be removed only by a vertical, or 90°, force applied to the spike member. The upper section 325 of spring 314 serves as a guide and bevel surface when base 321 is set in place.

The specific length of the stabilizer shaft and corresponding depth of the mating borehole are not critical so long as the desired stabilizing function is provided. It is preferable to terminate the borehole below the spike so that excessive wear of the spike will not expose the borehole.

Yet another embodiment of the invention is shown in detail in FIGS. 11 through 15, and is generally designated as 400. In this embodiment spike 429 is locked to receptacle 410 in both the lateral and rotational directions. The rotational locking is accomplished by the formation of fins 432 annularly spaced around the perimeter of base 430. Fins 432 are positioned to align with the spaces between spring fingers 413, 414, 415 and 416 and are sized to be closely received therein. Base 430 is here formed in the shape of a short cylindrical segment having a convex ring 433 protruding from and circumvolving the base's outer surface. However, it should be noted that the cross-sectional shape of base 430 is not limited to circular shapes and can additionally include both irregular and rectilinear shapes as well since spike 429 is locked in the rotational direction. Also, convex ring 433 is sized, shaped and positioned to frictionally engage a recess or groove 423 formed on the interior of spring fingers 413, 414, 415 and 416. This feature serves to lock spike 429 into receptacle 410. A stabilizer post recess 431 is formed within the interior of base 430 to receive and closely hold stabilizer post 412.

Receptacle 410 here has a circular anchor plate 411 from which stabilizer post 412 and spring fingers 413, 414, 415, and 416 extend. While anchor plate 411 is circular in this embodiment, its shape may be varied. An annular space between stabilizer post 412 and spring fingers 413, 414, 415 and 416 defines a receiving recess for base 430 of spike 429. The number of spring fingers and corresponding fins 432 may be varied. However, four arcuate fingers separated by four annularly spaced fins, at 90° from one another, has been found to promote lateral stabilization and provide a convenient alignment mechanism for inserting spike 429 into receptacle 410.

Preferably, both spike 429 and receptacle 410 are formed using injection molding techniques and a durable plastic material such as polyurethane for the spike and acetate for the receptacle, however other techniques and materials can be used. Additionally, receptacles 410 may be formed as part of the shoe sub-sole construction where a single sub-sole could act as the anchor plate for more than one receptacle. Additionally, it is possibly to interchange locations of the mechanical coupling elements, e.g. spring fingers, stabilizer post, base portion, convex section and stabilizer post receiving recess. For example, the short cylindrical segment, convex section, fins and stabilizer post recess could be formed on the anchor plate and the post and spring fingers formed on the spike. The locations of the elements can also be varied.

Also illustrated is one possible configuration for gripping surface 457 which is especially configured for manicured turf such as that found on a golf course. Here, the main body of spike 429 is formed in the shape of a spherical segment or dome, indicated at 458. A plurality of conical protuberances 459 are formed and annularly spaced around the marginal edges of dome 458. Each of the apexes 460 of protuberances 459 stop short of, or equal to, the apex of dome 458. This feature allows wear due to hard surfaces to bear primarily on dome 458, yet at the same time allows protuberances 459 to engage softer turf to provide traction to the user.

Figure 16:
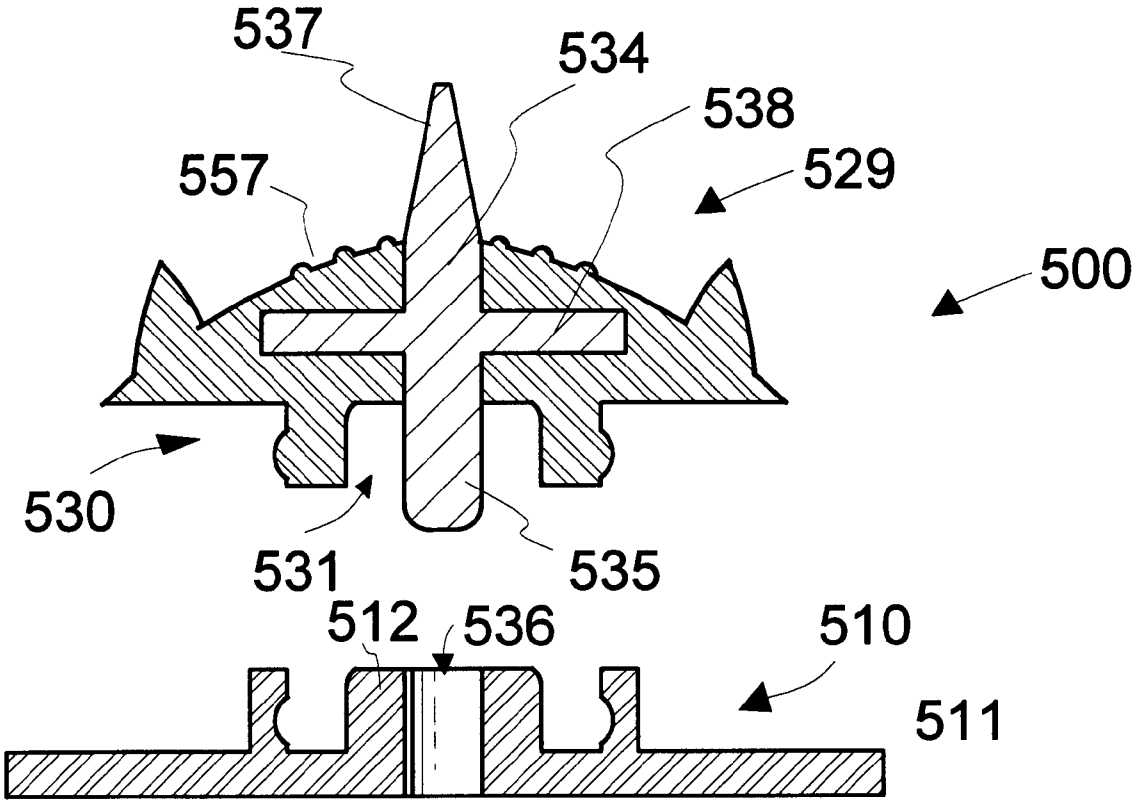
FIG. 16 is an exploded cross-sectional view of yet another embodiment of the invention.
Figure 17:
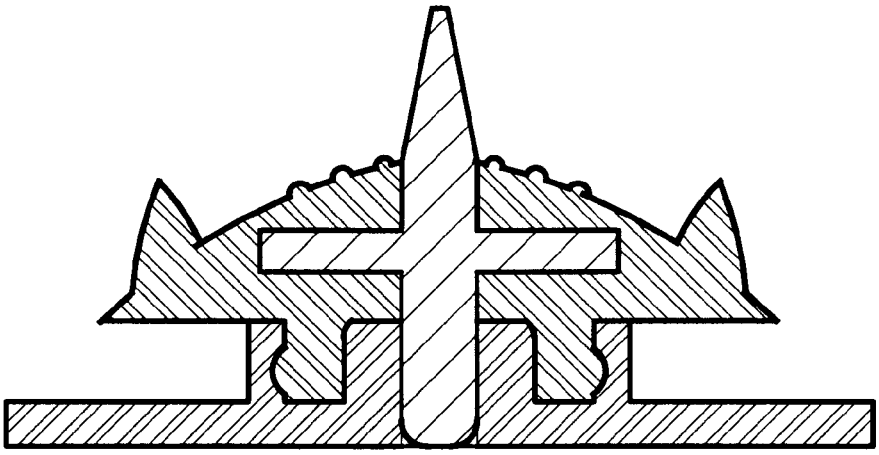
FIG. 17. is a cross-sectional view of the embodiment shown in FIG. 16 but in an assembled configuration.

FIGS. 16 and 17 show yet another embodiment of the invention designated as 500. Shoe spike apparatus 500 is similar to the previous embodiment with the exception of the addition of a relatively harder endoskeleton 534. Endoskeleton 534 is preferably formed of a metal such as steel or a similar material and with spike 529 being formed around endoskeleton 534 by injection molding or the like. Endoskeleton 534 includes a secondary stabilizer post 535 which protrudes centrally out of the base 530 and stabilizer post recess 531 in spike 529. A mating secondary stabilizer post receiving recess 536 is formed within stabilizer post 512 on anchor plate 511. Additionally, endoskeleton 534 includes a traction protuberance 537 which extends outward from gripping surface 557. Here, traction protuberance 537 is formed in the shape of a truncated cone, however other shapes can be used. Secondary stabilizer post 535 can be replaced by a plastic post formed integrally with the main body of spike 529.

Figure 18:
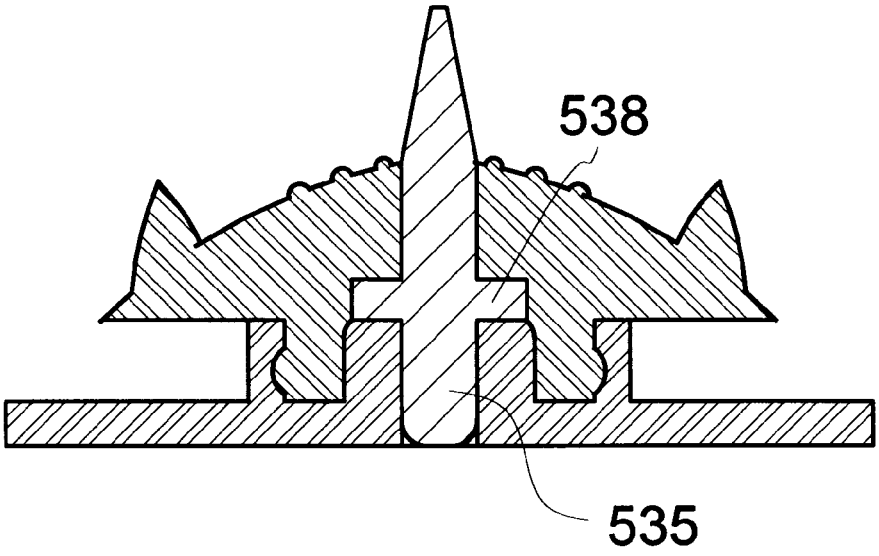
FIG. 18 is a crossectional view of yet another embodiment of the invention.

FIG. 18 shows yet another embodiment which is similar to the last embodiment except that flange 538 is positioned at the base of secondary stabilizer post 535 instead of intermediately along endoskeleton 534.

These particular embodiments exhibit two distinguishing advantages. First they provide an extremely secure snap attachment between the spike and the receptacle. Second, they combine the advantages of metal spikes with those of plastic spikes and allow a user to quickly change between a low profile plastic spike and a more traditional profile combination metal/plastic spike. This may be especially advantageous for an otherwise "spikeless" golf course or other atheletic facility to limit their liability for personal injury during wet conditions to help prevent slips and falls.

Having thus described in detail preferred embodiments of the present invention, it is to be appreciated and will be apparent to those skilled in the art that many physical changes could be made in the apparatus without altering the inventive concepts and principles embodied therein. The present embodiments, therefore, are to be considered in all respects as illustrative and not restrictive, the scope of the invention being indicated by the appended claims rather than by the foregoing description, and all changes which come within the meaning and range of equivalency of the claims, therefore, are to be embraced therein.

I claim:

1. Shoe spike apparatus comprising:

a receptacle having stabilizer post and a plurality of annularly spaced spring fingers surrounding the stabilizer post and secured with respect thereto, each of the spring fingers including a concave section;

a spike member having a base portion and a gripping portion, the base portion defining a recess for receiving the stabilizer post and having a convex section being geometrically conformed to mate with the concave sections of the spring fingers; and a plurality of fins extending from the base portion, each sized, shaped and positioned to be closely received within a space between two adjacent spring fingers.

2. The apparatus as described in claim 1 wherein the receptacle comprises an anchor plate adapted to be affixed to the sole of a shoe and wherein the stabilizer post and spring fingers are affixed substantially perpendicular to the anchor plate.

3. The apparatus of claim 2 wherein the anchor plate, the spring fingers, and the stabilizer post comprise a single unitary structure.

4. The apparatus of claim 1 further comprising:

an endoskeleton formed within the spike member, the endoskeleton having a traction protuberance extending outward from the gripping portion of the spike and a secondary stabilizer post protruding outward from the recess in the base portion of the spike; and the stabilizer post on the receptacle having a secondary stabilizer post receiving recess formed therein, sized and shaped to closely receive the secondary stabilizer post.

5. Shoe spike apparatus comprising:

a receptacle adapted to be secured to the base of a shoe;

a downwardly depending stabilizer shaft secured to the receptacle;

a plurality of spring fingers affixed to the receptacle and positioned in a spaced configuration with respect to the stabilizer shaft, each of the spring fingers having a substantially central section extending in the direction of the stabilizer shaft;

a spike member having a base portion and a gripping portion for gripping engagement with a foot support surface, the base portion defining a conforming opening for receiving the stabilizer shaft and further defining a reduced substantially central section having a geometrical configuration such that it mates with the central sections of the spring fingers; and a plurality of fins extending from the base portion, each sized, shaped and positioned to be closely received within a space between two adjacent spring fingers.

6. The apparatus as described in claim 5 wherein the receptacle comprises an anchor plate adapted to be affixed to the sole of a shoe and wherein the stabilizer shaft and the spring fingers are affixed substantially perpendicular to the anchor plate.

7. The apparatus of claim 6 wherein said spring fingers are beveled outwardly at their distal ends.

8. The apparatus of claim 7 further comprising:

an endoskeleton formed within the spike member, the endoskeleton having a traction protuberance extending outward from the gripping portion of the spike and a secondary stabilizer post protruding outward from the recess in the base portion of the spike; and the stabilizer shaft on the receptacle having a secondary stabilizer post receiving recess formed therein, sized and shaped to closely receive the secondary stabilizer post.

9. The apparatus of claim 6 further comprising:

an endoskeleton formed within the spike member, the endoskeleton having a traction protuberance extending outward from the gripping portion of the spike and a secondary stabilizer post protruding outward from the recess in the base portion of the spike; and the stabilizer shaft on the receptacle having a secondary stabilizer post receiving recess formed therein, sized and shaped to closely receive the secondary stabilizer post.

10. The apparatus of claim 5 further comprising:

an endoskeleton formed within the spike member, the endoskeleton having a traction protuberance extending outward from the gripping portion of the spike and a secondary stabilizer post protruding outward from the recess in the base portion of the spike; and the stabilizer shaft on the receptacle having a secondary stabilizer post receiving recess formed therein, sized and shaped to closely receive the secondary stabilizer post.

* * * * *